US005781185A

United States Patent [19]

Shin

[11] Patent Number: 5,781,185

[45] Date of Patent: Jul. 14, 1998

[54] DISPLAY DEVICE CAPABLE OF MODE DETECTION AND AUTOMATIC CENTERING

[75] Inventor: Hyeog-sang Shin, Kyonggi-do, Rep. of Korea

[73] Assignee: Samsung Electronics, Co., Ltd., Kyungki-Do, Rep. of Korea

[21] Appl. No.: 649,444

[22] Filed: May 17, 1996

[30] Foreign Application Priority Data

May 17, 1995 [KR] Rep. of Korea ..... 1995-12244

[51] Int. Cl.[6] ..... G09G 3/00

[52] U.S. Cl. ..... 345/213; 345/204; 345/132; 348/542

[58] Field of Search ..... 345/132, 3, 204, 345/94, 100, 211, 212–215; 348/491, 492, 529, 530, 540, 542, 546, 543, 544, 545; 327/176

[56] References Cited

U.S. PATENT DOCUMENTS 4,060,975 12/1977 Yamaguchi ..... 345/49

5,111,190 5/1992 Zenda ..... 345/132

5,189,401 2/1993 Kugler, Jr. et al. ..... 345/150

5,404,153 4/1995 Kim ..... 345/132

5,521,614 5/1996 Kotha et al. ..... 345/131

*Primary Examiner*—Lun-Yi Lao

*Attorney, Agent, or Firm*—Cushman Darby&Cushman IP Group of Pillsbury Madison & Sutro LLP

[57] ABSTRACT

A mode-detecting device is described which comprises a first and a second synchronization detecting unit which receive a vertical synchronization signal and a horizontal synchronization signal. A vertical synchronization delay unit delays the Vp section of the vertical synchronization signal by 24H of the horizontal synchronization signal. A pulse generating unit generates a pulse from the 600th clock of the clock signals of the delayed vertical synchronization signal. First and a second detecting units receive the pulse from the 600th clock as a clock input and respectively receive the vertical and horizontal synchronization signals. Upon detecting the 600th clock, the polarity of the vertical and the horizontal synchronization signals are respectively output to first and second selecting means, and can be used to determine one of a plurality of display modes so that automatic centering can be accomplished.

4 Claims, 9 Drawing Sheets

640*480 Mode

640*350 Mode

640*400 Mode

640*480 Mode

640*400 Mode

640*350 Mode

DISPLAY DEVICE CAPABLE OF MODE DETECTION AND AUTOMATIC CENTERING

BACKGROUND OF THE INVENTION (1) Field of the Invention

The present invention relates to a display device having functions of mode detection and automatic centering, and more particularly to a display device which displays are automatically centered after detecting it is in a 640×400 mode or a 640×350 display mode.

(2) Description of the Related Art

Liquid crystal display (LCD) devices display data on an LCD panel with the signals from a graphic card of a computer. The input signals are a vertical synchronizing signal VSYNC, a horizontal synchronizing signal HSYNC, a clock signal MCLK, and R, G, B data signals.

In addition, there are different display modes for videographics such as 640×480, 640×400, 640×350. The polarities of the VSYNC and the HSYNC are changed and input in each mode.

FIGS. 1 to 3 illustrate the wave forms of each mode signal of a conventional display driving circuit. FIGS. 4A–4C show an example of automatic centering displays.

As illustrated in FIG. 1, data signals are input after an initializing portion Vp of VSYNC and after 34H of the HSYNC in the 640×480 mode. As illustrated in FIGS. 2 and 3, data signals are input after an initializing portion Vp of VSYNC and after 61H of the HSYNC in the 640×350 mode. In the 640×400 mode, data signals are input after a high initializing portion Vp of VSYNC and after 34H.

For the convenience of a user, there is a need to detect any mode for any given input VSYNC and HSYNC by a LCD interface card, and perform centering in the 640×400 mode and the 640×350 mode.

However, the conventional method for detecting the mode of a display device is too complicated, there is an inconvenience in setting centering information into the graphic card, and the number of gates in the circuit to perform mode detection is to large.

SUMMARY OF THE INVENTION

Accordingly, an object of the invention is to solve the problems of prior art and to provide a display device having functions of mode detection and automatic centering which displays automatically with centering without setting in a graphic card at 640×400 mode or 640×350 mode, after detecting each display mode, and has a simple structure having small numbers of gate.

To achieve the above object and others, a mode-detecting detecting device comprises a first and a second synchronization detecting unit which receive a vertical synchronization signal and a horizontal synchronization signal. A vertical synchronization delay unit delays the Vp section of the vertical synchronization signal by 24H of the horizontal synchronization signal. A pulse generating unit generates a pulse from the 600th clock of the clock signals of the delayed vertical synchronization signal. First and a second detecting units receive the pulse from the 600th clock as a clock input and respectively receive the vertical and horizontal synchronization signals. Upon detecting the 600th clock, the polarity of the vertical and the horizontal synchronization signals are respectively output to first and second selecting means, which also receive inverted horizontal and vertical synchronization signals. Whether the inverted or noninverted signals are output depends upon the detected polarity of the vertical and horizontal synchronization signals at the 600th clock pulse.

Automatic centering is accomplished using a counter which receives the vertical and the horizontal synchronization signals output from the first and the second selecting means of the mode detecting unit and counts whenever the vertical synchronization signal is input. A reader generates a starting signal from the first vertical synchronization signal and a starting signal from the 35th vertical synchronization signal by reading the counter output signal. A selecting means which receives the starting signal from the first and 35th vertical synchronization signals and the vertical and the horizontal detection result signals output from the first and the second detecting units and thus generates as appropriately timed vertical start pulse.

DETAILED DESCRIPTION OF THE PREFERRED EMBODIMENTS

Figure 5:
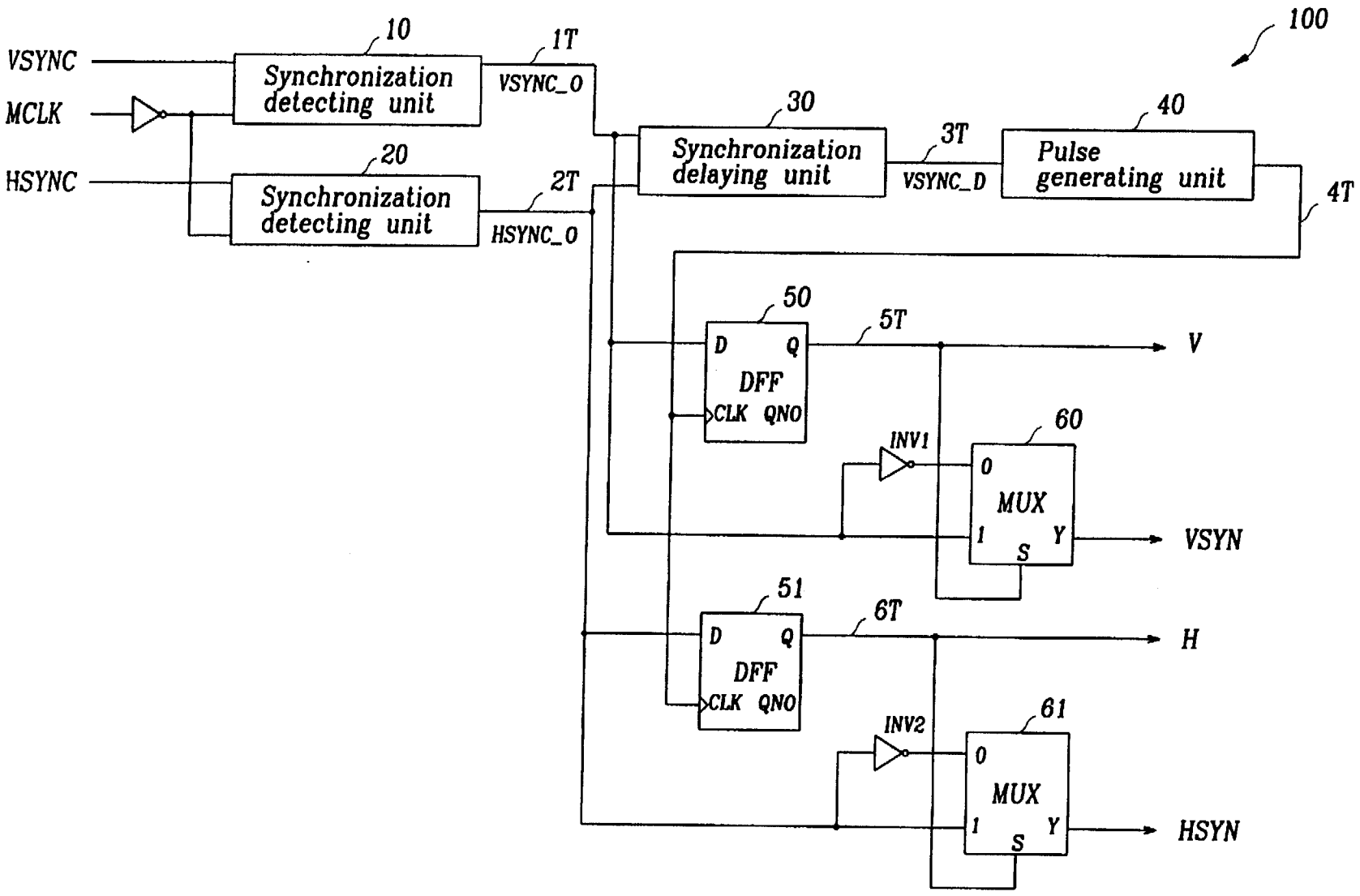
FIG. 5 shows a block diagram of a display mode detecting device according to the first embodiment of the present invention.

As illustrated in FIG. 5, a display mode detecting device according to a first embodiment of the invention comprises a first and a second synchronization detecting units 10 and 20 which respectively receive a vertical synchronization signal VSYNC and a horizontal synchronization signal HSYNC and both receive a clock signal MCLK. Detecting units 10 and 20 eliminate high-end noise of each signal and output VSYNC-O and HSYNC-O signals, respectively. A vertical synchronization delaying unit 30 receives the outputs of two synchronization detecting units 10 and 20 and outputs a vertical synchronization delay signal VSNC-D after delay to make up for the length of the Vp section of the vertical synchronization signal, which delay can be up to 24H of the horizontal synchronization signal. A pulse generating unit 40 receives an output of the vertical synchronization delaying unit 30 and generates and outputs a pulse after detecting the 600th clock of the clock signal MCLK upon receipt of the delayed vertical synchronization signal VSYNC-D. First and a second D-Flip-Flops 50 and 51 receive at a common clock input the pulse signal output from the pulse generating unit 40 and respectively receive the vertical synchronization signal VSYNC-O and horizontal synchronization signal HSYNC-O output from the synchronization detecting units 10 and 20. After detecting the polarity of the vertical and the horizontal synchronization signals in the 600th clock, first and second D-Flip-Flops 50 and 51 output from a pulse signal. A first multiplexer 60 receives the pulse signal output from the first D-Flip-Flop 50 at a selection controlling input S and an inverted output and a non-inverted output of the first synchronization detecting unit 10 respectively at a "0" input address and a "1" input address and outputs one of these input signals according to the input selection controlling signal. A second multiplexer 61 receives the pulse signal output from the second D-Flip-Flop at a selection controlling input S and an inverted output and a non-inverted output of the first synchronization detecting unit 20, respectively at a "0" address input and a "1" address input, and outputs are of those input signals according to the input selection controlling signal. Two inverters INV1 and INV2 invert each output of the first and the second synchronization detecting units 10 and 20 to obtain the inverted VSYNC-O and HSYNC-O signals, respectively.

Figure 7:
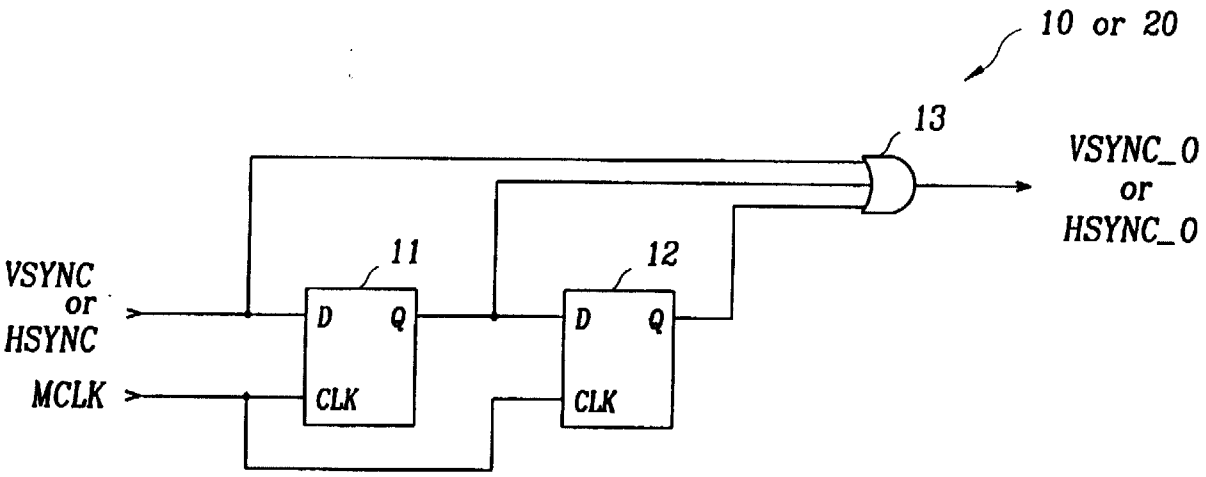
FIG. 7 shows a block diagram of a synchronization detecting unit of the display mode detecting device illustrated in FIG. 5.

The first and the second synchronization detecting units 10 and 20 are illustrated in FIG. 7 and comprise a first D-Flip-Flop 11 which receives the vertical or the horizontal synchronization signals VSYNC or HSYNC and a clock signal MCLK and outputs these signals after momentarily storing them based upon the clock signal MCLK. A second D-Flip-Flop 12 receives the output of the first D-Flip-Flop 11 and a clock signal and outputs this signal after momentarily storing it based upon the clock signal MCLK. An OR gate 13 receives one of the vertical and the horizontal synchronization signals VSYNC and HSYNC and the delayed signals of the first and the second D-Flip-Flops 11 and 12 and eliminates noise by performing a logical OR operation.

Figure 8:
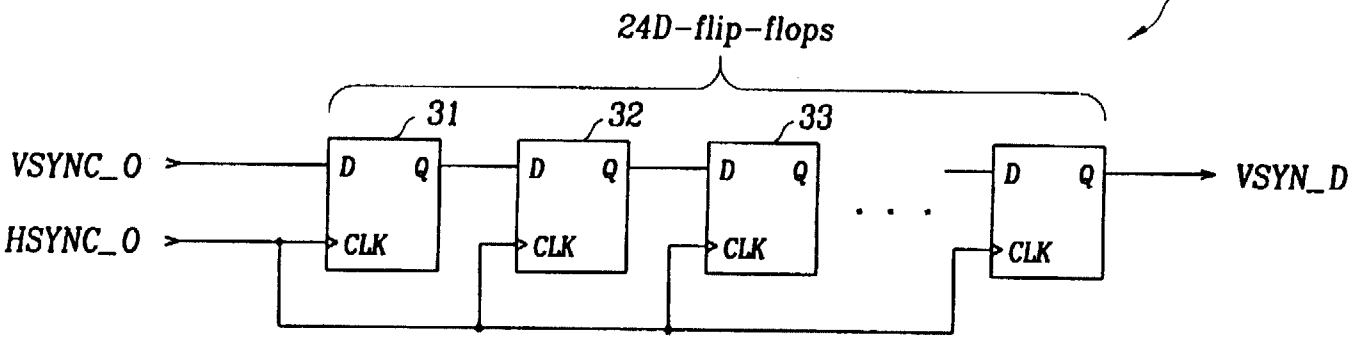
FIG. 8 shows a block diagram of a vertical synchronization delaying unit of the display mode detecting device illustrated in FIG. 5.

The vertical synchronization delaying unit 30 is illustrated in FIG. 8 and is comprised of a serial chain of 24 D-Flip-Flops, the first of which receives the vertical synchronization signal VSYNC-O at the D input and each subsequent D-Flip-Flop receives at its D input the output of the previous terminal. Each of these D-Flip-Flops receive the horizontal synchronization signal HSYNC-O at a clock input. As a result, the VSYNC-O signal is delayed 24H to obtain the VSNC-D signal.

Figure 9:
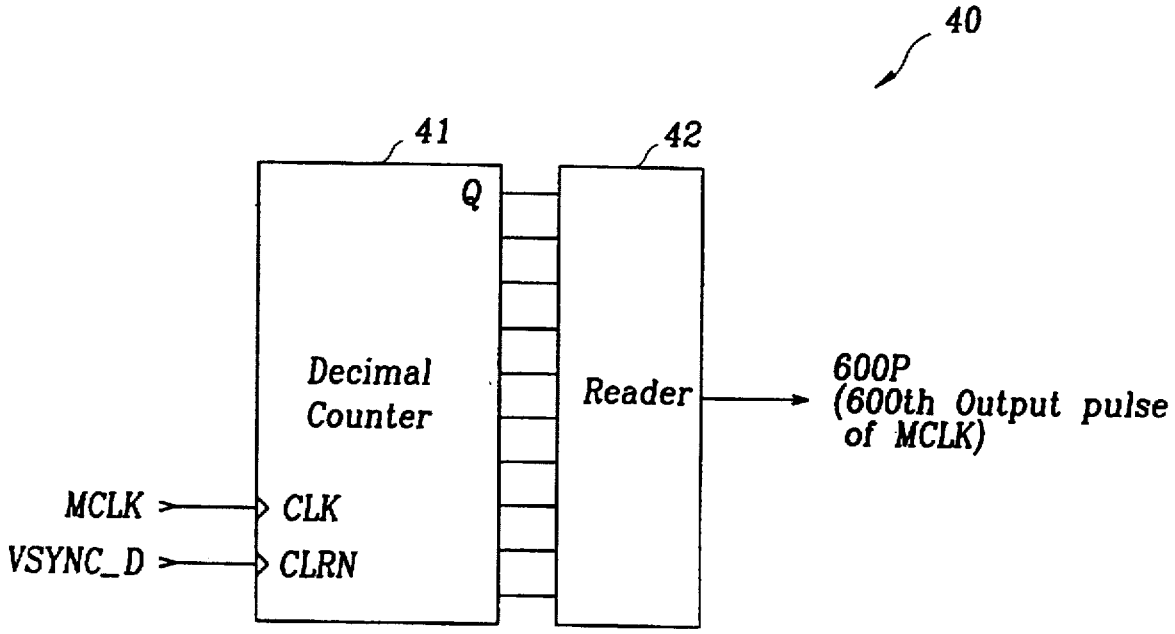
FIG. 9 shows a block diagram of a pulse generating unit of the display mode detecting device illustrated in FIG. 5.

The pulse generating unit 40 illustrated in FIG. 9 includes a decimal counter 41, which receives the delayed signal VSYNC-D output from the vertical synchronization delaying unit 30 and a clock signal MCLK and counts whenever the clock signal is input, and a reader 42 which outputs a pulse generated at the 600th clock signal by reading the signal counted by the decimal counter 41.

Automatic centering is thus accomplished by detecting the polarity of the VYNSC and HSYNC signals 600 MCLK pulses after a 24HSYNC delay from the beginning of the Vp section of the VSYNC signal. The number of the horizontal synchronization signals HSYNC from the beginning of the Vp section of the vertical synchronization signal HSYNC can vary. In a preferred embodiment of the invention, the number of the HSYNC pulses is twenty-four.

In addition to the structure described above, a display mode detecting device according to the invention as illustrated in FIG. 5 includes first and second inverters INV1 and INV2 and first and second multiplexers 60 and 61 which output the polarity of the vertical and the horizontal synchronization signals of the 640×400 and the 640×350 modes after changing into −180 mode, if the polarity of the vertical and the horizontal signals are detected by the first and the second D-Flip-Flops 50 and 51 by using the pulse generated from the pulse generating unit 40.

Figure 6:
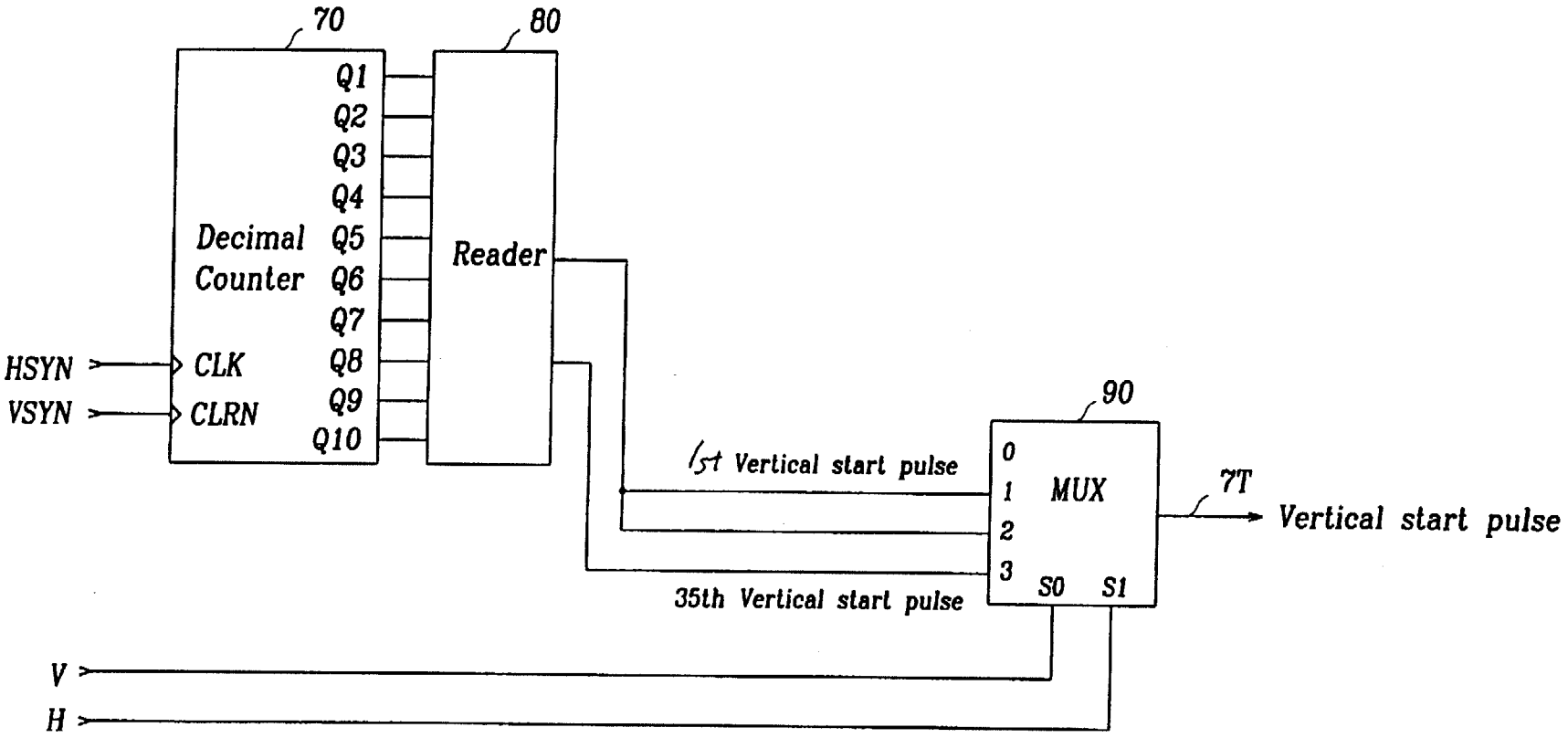
FIG. 6 shows a block diagram of an automatic centering display according to the second embodiment of the present invention.

FIG. 6 illustrates an automatic centering display according to the invention. A decimal counter 70 receives the vertical and the horizontal synchronization signals VSYN and HSYN output from the first and the second multiplexers 60 and 61 of the mode detecting unit and counts whenever the vertical synchronization signal VSYN is input. A reader 80 generates and outputs a first vertical starting pulse from the first vertical synchronization signal and a thirty fifth starting signal from the 35th vertical synchronization signal by reading the signal counted by the decimal counter 70. A multiplexer 90 receives at inputs 1 and 2 the first vertical starting pulse the thirty fifth vertical starting pulse at an input 3, and the vertical and the horizontal detection result V and H signals, respectively output from the first and the second D-Flip-Flops 50 and 51 of the mode detecting unit at controlling inputs 50 and 51. Multiplexer outputs a vertical start pulse after selecting an input according to the input controlling signal.

Figure 1:
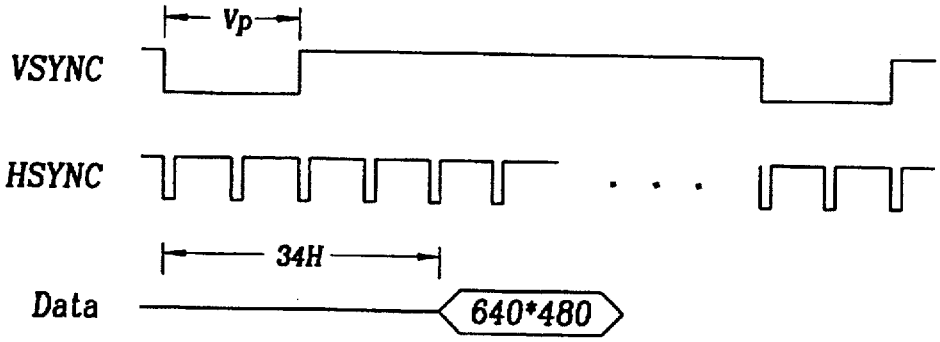
Prior Art FIG. 1
FIG. 1 shows a signal wave form of a 640×480 mode conventional display driving unit.
Figure 2:
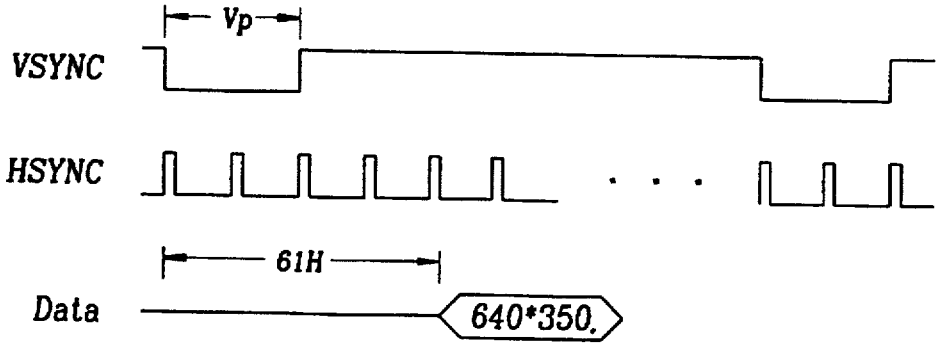
Prior Art FIG. 2
FIG. 2 shows a signal wave form of a 640×350 mode conventional display driving unit.
Figure 3:
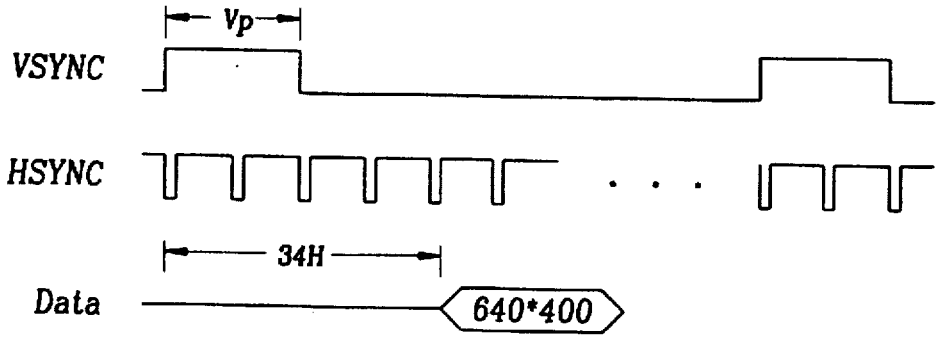
Prior Art FIG. 3
FIG. 3 shows a signal wave form of a 640×400 mode conventional display driving unit.
Figure 4A:
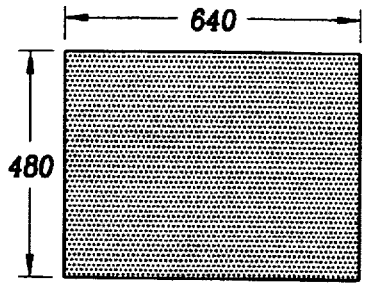
FIGS. 4A–4C show the modes of an automatic centering display.
Figure 4B:
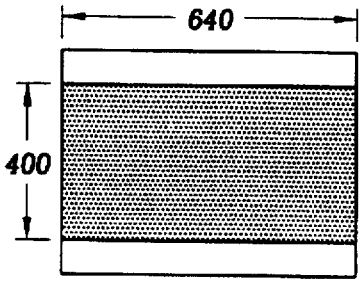
Figure 4C:
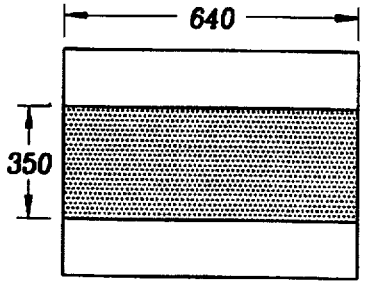

The automatic centering display device according to the second embodiment of the invention illustrated in FIG. 6 uses the signals V and H indicating the results detected through the display mode detecting device illustrated in FIG. 5, the decimal counter 70 and the reader 80, so that the multiplexer 90 outputs the vertical starting signal at the appropriate time to perform centering automatically. Thus, the centering illustrated in FIGS. 4A–4C are automatically accomplished by detection of the display mode.

Figure 10:
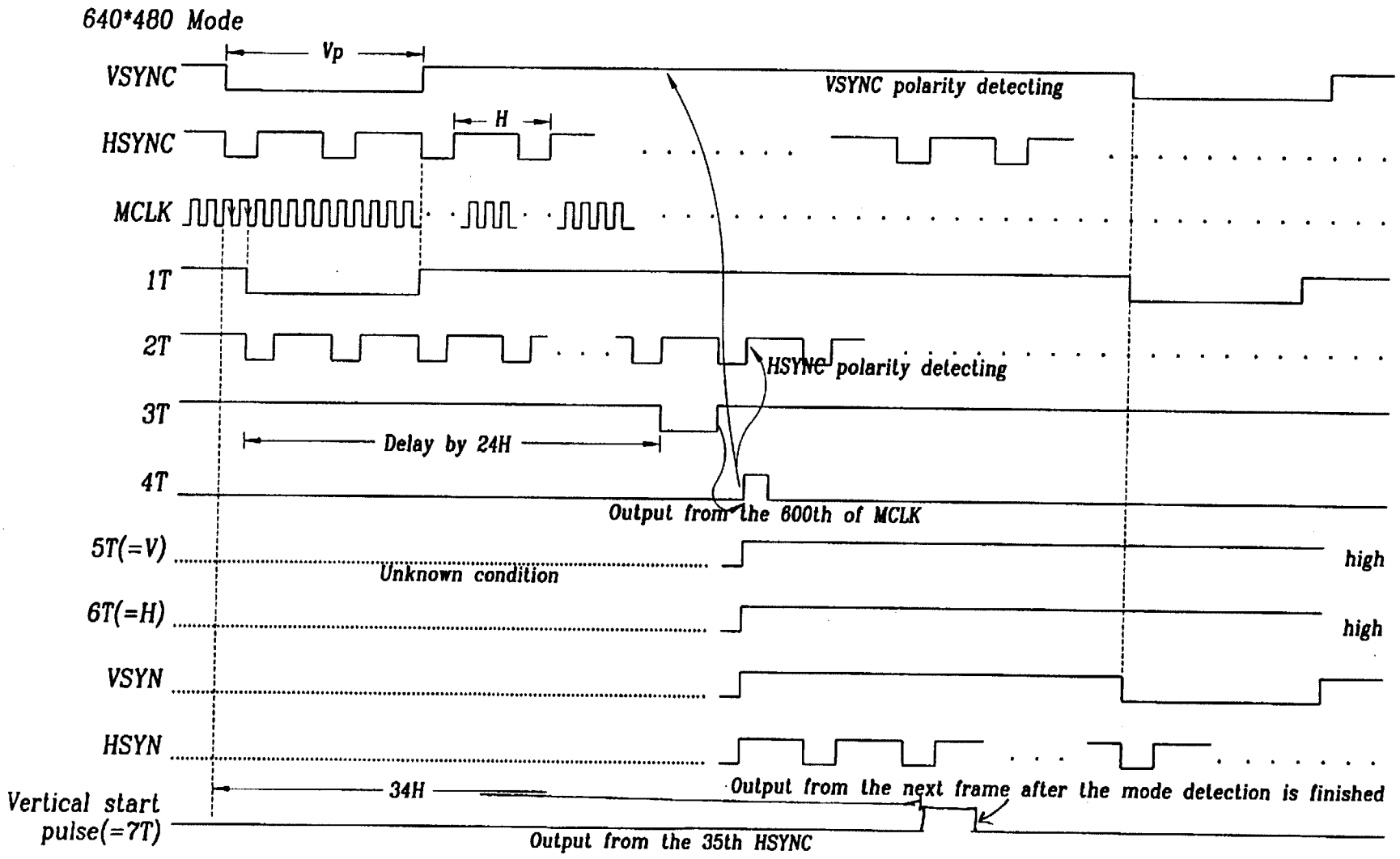
FIG. 10 is a timing diagram of the 640×480 display mode according to a preferred embodiment of the invention.

As illustrated in FIG. 10, in the 640×480 display mode from the 600th clock MCLK, the polarity of the vertical and the horizontal synchronization signals VSNC and HSYNC, respectively, and the vertical and the horizontal detecting result signals V and H, respectively, are output at high levels. As a result, multiplexer 90 in FIG. 6 outputs a vertical start pulse at the 35th HSYNC so that the image is centered, as illustrated in FIG. 4A.

When the vertical starting pulse is output from the first horizontal synchronization signal, as in wave form 7T of FIG. 10, the position to be displayed on the panel begins from the vertical 35th so that 400 lines are displayed thereafter in the 600×400 mode.

Figure 11:
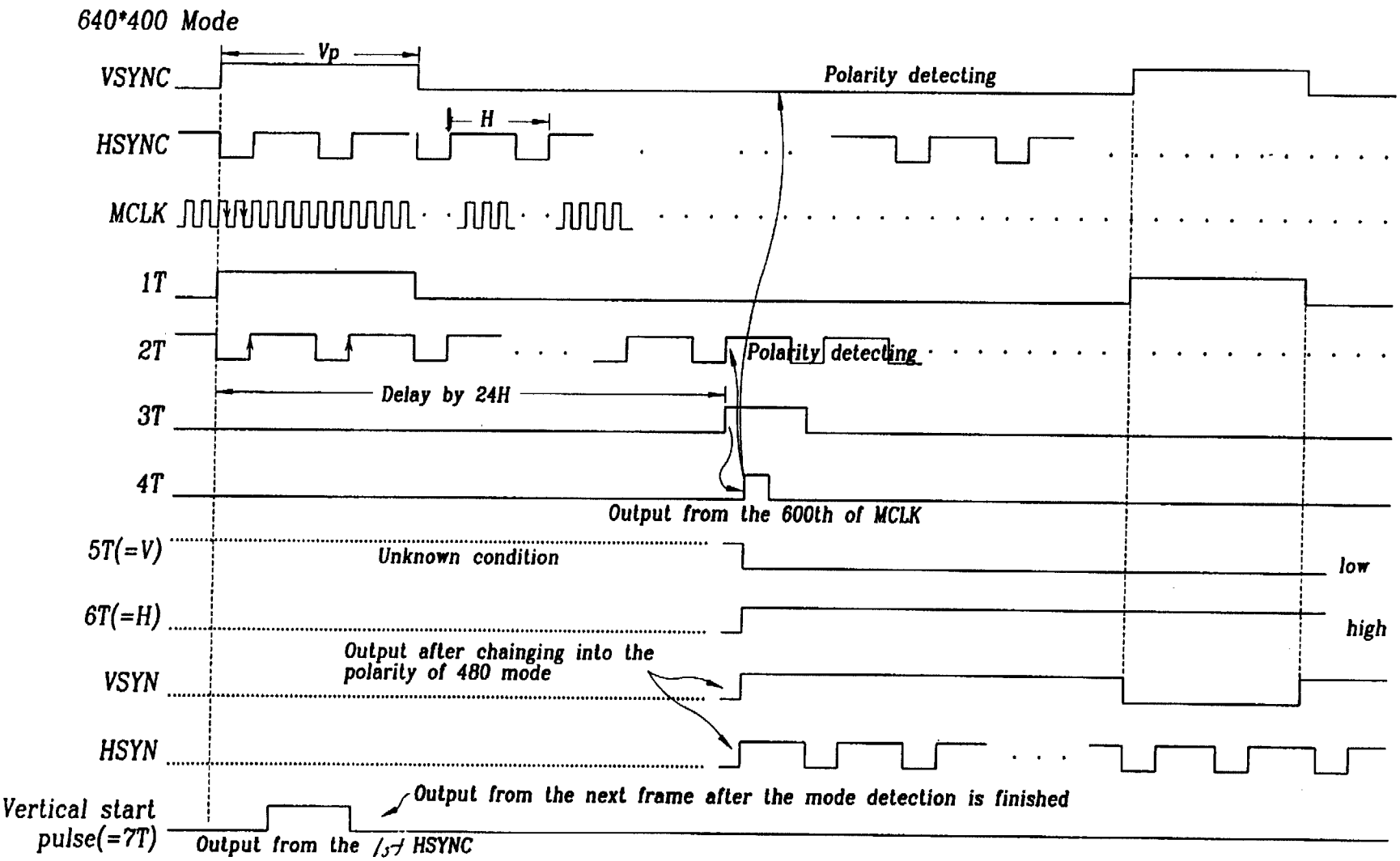
FIG. 11 is a timing diagram of the 640×400 display mode according to a preferred embodiment of the invention.

As illustrated in FIG. 11, in the 640×400 display mode the vertical detecting result signal V is output at a low level, and the horizontal detecting result signal H is output at a high level. As a result, multiplexer 90 in FIG. 6 outputs a vertical start pulse at the 1st HSYNC so that the image is centered, as illustrated in FIG. 4B.

When the vertical starting pulse is output from the first horizontal synchronization signal, as in wave form 7T of FIG. 11, the position to be displayed on the panel begins from the vertical 35th so that 400 lines are displayed thereafter in the 600×400 mode.

Figure 12:
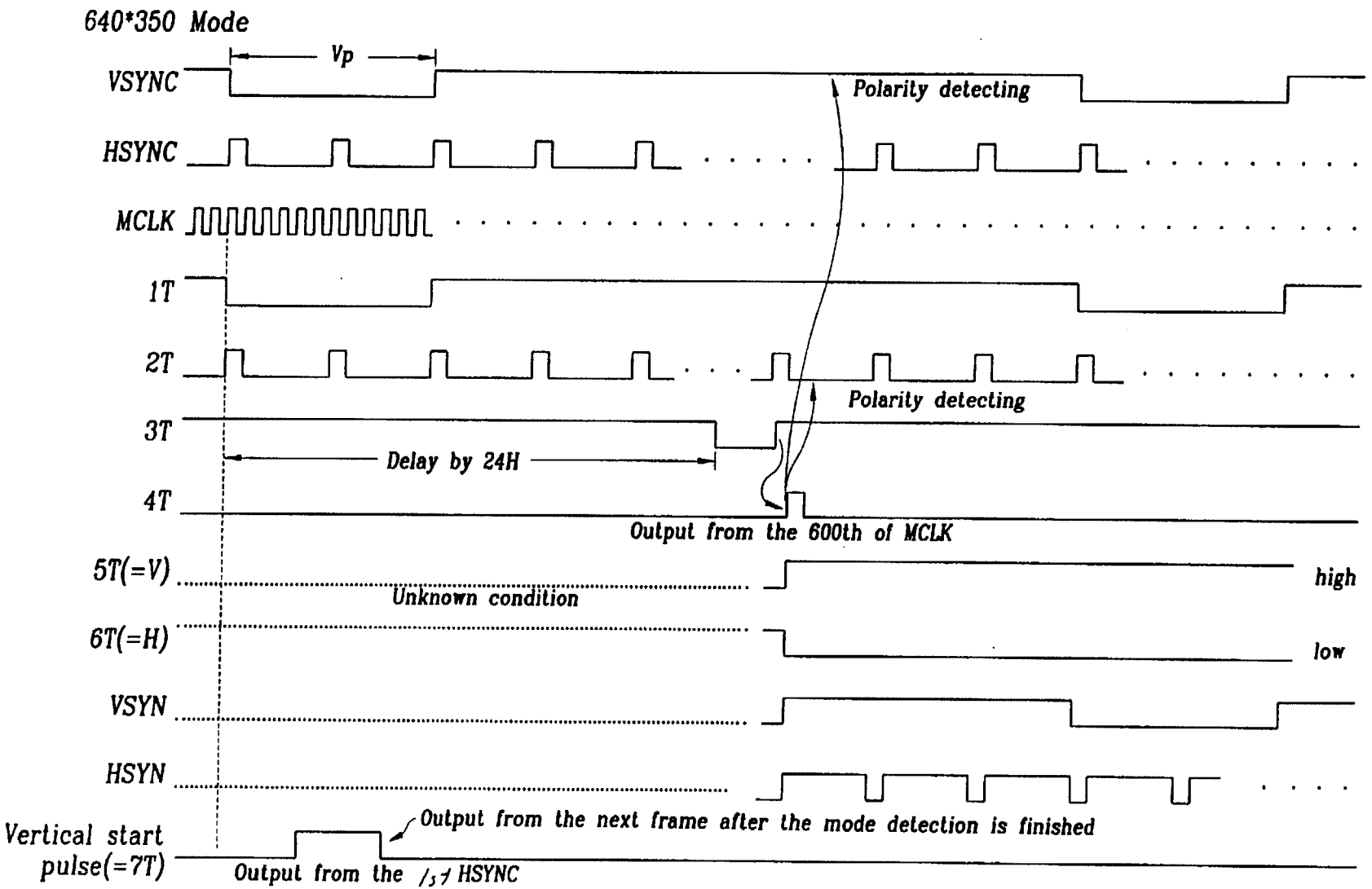
FIG. 12 is a timing diagram of the 640×350 display mode according to a preferred embodiment of the invention.

As illustrated in FIG. 12, in the 640×350 display mode, the vertical detecting result signal V is output at a high level and the horizontal detecting result signal H is output at a low level. As a result, multiplexer 90 in FIG. 6 outputs a vertical start pulse at the 1st HSYNC so that the image is centered, as illustrated in FIG. 4C.

When the vertical starting pulse is output from the first horizontal synchronization signal, as in wave form 7T of FIG. 12, the position to be displayed on the panel begins from the vertical 62nd so that 350 lines are displayed thereafter in the 640×350 mode.

Accordingly, a display device having functions of mode detection and automatic centering according to the preferred embodiments of the invention displays automatically after centering without setting in a graphic card in 640×400 mode or a 640×350 mode and is comprised of a simple circuit having a small number of gates.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed is:

1. A display device control circuit comprising:

a vertical synchronization delaying unit which receives a vertical synchronization signal and a horizontal synchronization signal and outputs a delayed vertical synchronization signal;

a pulse generating unit which receives said delayed vertical synchronization signal and generates a pulse a predetermined number of clock periods after receiving said vertical syrchronizal signal;

first and second detecting units which each receive at a clock input said pulse and respectively receive said vertical and horizontal synchronization signals and respectively output vertical and horizontal detected signals which indicate a polarity of said respective vertical and horizontal synchronization signals at a time corresponding to generation of said pulse, said polarity of said vertical and horizontal detected signals indicating one display mode from a potential plurality of display modes and usable to perform automatic centering of data associated with said vertical and horizontal synchronization signals;

a first multiplexer which receives said vertical detected signal at a selector input, said vertical synchronization signal and an inverted vertical synchronization signal, said vertical detected signal being used to select for output as an output vertical synchronization signal one of said vertical synchronization signal and said inverted vertical synchronization signal so that said output vertical synchronization signal will always have the same polarity regardless of said display mode; and a second multiplexer which receives said horizontal detected signal at a selector input, said horizontal synchronization signal and an inverted horizontal synchronization signal, said horizontal detected signal being used to select for output as an output horizontal synchronization signal one of said horizontal synchronization signal and said inverted horizontal synchronization signal so that said output horizontal synchronization signal will always have the same polarity regardless of said display mode.

2. A display device control circuit according to claim 1 further including:

first and second synchronization detecting units which respectively eliminate noise in said vertical and horizontal synchronization signals.

3. A display device control circuit according to claim 2 wherein each of said first and said second synchronization units comprise:

a first D-Flip-Flop which receives one of an input vertical synchronization signal and an input horizontal synchronization signal as well as a clock signal and outputs a first signal;

a second D-Flip-Flop which receives said first signal and said clock signal and outputs a second signal; and an OR gate which receives said one of said input vertical synchronization signal and input horizontal synchronization signal as well as said first and second signals and outputs one of said vertical and horizontal synchronization signals.

4. A display device control circuit according to claim 1 further including an automatic centering circuit comprising:

a decimal counter which receives said output vertical synchronization signal at a clear input and said output horizontal synchronization signal at a clock input and counts output horizontal synchronization signal pulses upon input of said output vertical synchronization signal; and a reader which generates a plurality of initial vertical start pulses; and a multiplexer which receives said plurality of initial vertical start pulses and selects one of them in dependence on said vertical and horizontal detected signals to obtain a vertical start pulse corresponding to said one display mode.

* * * * *